US007137935B2

(12) United States Patent
Clarke et al.

(10) Patent No.: US 7,137,935 B2
(45) Date of Patent: Nov. 21, 2006

(54) OFFICE GYM EXERCISE KIT

(76) Inventors: Raymond Clarke, 28111 Southside Island Creek Rd., Trappe, MD (US) 21673; Lorri Wilson-Clarke, 28111 Southside Island Creek Rd., Trappe, MD (US) 21673

( * ) Notice: Subject to any disclaimer, the term of this patent is extended or adjusted under 35 U.S.C. 154(b) by 287 days.

(21) Appl. No.: 10/827,377

(22) Filed: Apr. 20, 2004

(65) Prior Publication Data

US 2005/0233875 A1 Oct. 20, 2005

(51) Int. Cl.
*A63B 21/02* (2006.01)

(52) U.S. Cl. ..... 482/123; 482/121; 482/124; 482/126; 482/904

(58) Field of Classification Search ..... 482/121–124, 482/126, 129, 904
See application file for complete search history.

(56) References Cited

U.S. PATENT DOCUMENTS

| | | | | |
|---|---|---|---|---|
| 650,656 | A | 5/1900 | Raabe | |
| 2,160,722 | A | 5/1939 | Cunningham | |
| 4,815,731 | A * | 3/1989 | Suarez et al. | 482/124 |
| 5,007,417 | A * | 4/1991 | Bender | 602/27 |
| D319,273 | S | 8/1991 | Fox | |
| 5,090,694 | A | 2/1992 | Pauls et al. | |
| 5,141,482 | A | 8/1992 | Hern | |
| 5,171,295 | A | 12/1992 | Schwalm, Jr. | |
| 5,178,596 | A | 1/1993 | McIntire | |
| 5,324,243 | A | 6/1994 | Wilkinson | |
| 5,336,151 | A * | 8/1994 | Van Ballegooie | 482/124 |
| 5,362,295 | A | 11/1994 | Nurge | |
| 5,362,296 | A | 11/1994 | Wang et al. | |
| 5,490,826 | A * | 2/1996 | Rose | 482/74 |
| 5,505,677 | A * | 4/1996 | Hinds | 482/10 |
| 5,599,260 | A | 2/1997 | Rovinsky et al. | |
| 5,624,360 | A | 4/1997 | Wilkins | |
| 5,643,159 | A * | 7/1997 | Iavarone | 482/125 |
| 5,690,594 | A | 11/1997 | Mankovitz | |
| 5,743,838 | A | 4/1998 | Willis | |
| 5,803,881 | A * | 9/1998 | Miller | 482/124 |
| 6,048,292 | A | 4/2000 | Gasquez | |
| 6,099,445 | A | 8/2000 | Rovinsky et al. | |
| 6,117,056 | A | 9/2000 | Cataldi, Jr. et al. | |
| 6,159,133 | A | 12/2000 | Shugg | |
| 6,500,104 | B1 | 12/2002 | Rich | |
| 6,540,705 | B1 * | 4/2003 | Norstrem et al. | 602/5 |
| 6,692,415 | B1 * | 2/2004 | Winston | 482/126 |

(Continued)

FOREIGN PATENT DOCUMENTS

| | | |
|---|---|---|
| CA | 2 436 231 | 7/2002 |

(Continued)

*Primary Examiner*—Stephen R. Crow
*Assistant Examiner*—Allana Lewin
(74) *Attorney, Agent, or Firm*—Richard C. Litman

(57) ABSTRACT

The office gym exercise kit is a portable exercise kit that provides for a number of exercises to be performed by a user, including arm, leg and back exercises. The kit components are capable of attaching about a chair post and a chair back support to provide the exercises for the user. A flexible body is wrapped around the post and under the base of the chair then secured such that the flexible body remains in place around the chair post. A flexible band is wrapped around the chair back support. Both the flexible body and flexible band have retainers attached thereon. Several elastic straps are included in the kit. The elastic straps may be fastened to the flexible body and flexible band by latching onto the retainers. The user then exercises by extending the elastic straps with arms, legs or the like.

9 Claims, 6 Drawing Sheets

U.S. PATENT DOCUMENTS

2002/0142898 A1 10/2002 Willis et al.
2004/0053756 A1 3/2004 Tremayne
2005/0043154 A1* 2/2005 Atrizadeh ..... 482/124

FOREIGN PATENT DOCUMENTS

WO WO 02/056971 A1 7/2002

* cited by examiner

OFFICE GYM EXERCISE KIT

BACKGROUND OF THE INVENTION

1. Field of the Invention

The present invention relates to exercise equipment, and particularly to an exercise kit adapted to be used with an office chair.

2. Description of the Related Art

Although there are a number of exercise devices on the market, there are few which are portable and fewer still that provide a range of exercise options for an individual exerciser. Many exercise devices are cumbersome and much larger than is convenient to relocate. Additionally, many individuals have the desire to exercise in easily accessible locations without the difficulty involved in obtaining various types of equipment. Thus it is advantageous to have an exercise device that is portable, lightweight and capable of being used in a number of surroundings, such as homes, offices and the like.

One way to provide for various exercises in convenient locations is to use a portable exercise device in combination with home or office furniture or room components such as doors. The related art endeavors to supply a portable exercise device that provides a range of exercise movements. However, there is a need for a portable exercise device that is easily attached to an office or home chair and that allows a user to engage in a great variety of exercise movements. Additionally, there is a need for a portable exercise device that is simply constructed using inexpensive materials.

U.S. Pat. No. 5,690,594, issued Nov. 25, 1997 to R. Mankovitz, describes an exercise apparatus for attachment to a post of a chair. The exercise apparatus has a foot support bar that allows a user's foot to extend along the bar. Wheels are mounted to the foot support and resilient members serve to attach the foot support bar to the post of the chair. The user then sits in the chair and pushes the foot support bar away from the chair, thereby exercising the user.

U.S. Pat. No. 5,599,260, issued Feb. 4, 1997 to Rovinsky et al., shows an exercise device with a roller attached to the post of a chair by an elastic stretchable element. The roller can be employed by the user to exercise either the user's foot or arm. The roller has a piece connected to it to allow for foot placement. Additionally, the user can unfold the roller such that it can be taken into the user's arm for arm exercises.

U.S. Pat. No. 6,099,445, issued Aug. 8, 2000 to Rovinsky et al., describes an exercise device having a rigid frame and a number of exercise elements connected to the rigid frame. The frame is capable of being mounted on the central post of a chair. The exercise elements connected to the frame allow the user to exercise the user's legs, arms, and neck.

U.S. Pat. No. 5,743,838, issued Apr. 28, 1998 to Willis, shows a method of making an exercising device and the device itself. The exercise device has a flexible body that is wrapped about the back of a chair and an elastic member attached to the flexible body. The elastic member can accommodate a limb and the user may extend the elastic member away from the chair in order to exercise the limb.

U.S. Pat. No. 5,141,482, issued Aug. 25, 1992 to Hern, describes an exercise device that is strapped about the back of a chair. The exercise device includes a seat-engaging strap, a chest strap and shoulder straps. The chest and shoulder straps are wrapped about the chest of a user and tension members connect the chest and shoulder straps to the seat-engaging strap that is secured about the chair. When the user leans forward, the resistance from the device tightens his stomach muscles.

U.S. Pat. No. 5,624,360, issued Apr. 29, 1997 to Wilkins, describes a portable exercise device having handgrips, elastic bands and anchor brackets. The anchor brackets are clamped onto a door and joined to the handgrips by the elastic bands. The user then grasps the handgrips and stretches the elastic bands, thereby exercising the user's arms. The device may also be used to exercise other parts of the body, including feet, upper torso, etc.

Other patents showing exercise devices include U.S. Pat. No. Des. 319,273, issued Aug. 20, 1991 to S. Fox (vehicular exerciser); U.S. patent Pub. No. US 2002/0142898 A1, published Oct. 3, 2002 and invented by W. Willis et al. (office exercise furniture); U.S. patent Pub. No. US 2004/0053756 A1, published Mar. 18, 2004 and invented by T. Tremayne (exercise device); U.S. Pat. No. 650,656, issued May 29, 1900 to J. Raabe (exercising apparatus); U.S. Pat. No. 2,160,722, issued May 30, 1939 to J. Cunningham (foot exerciser); U.S. Pat. No. 5,090,694, issued Feb. 25, 1992 to E. Pauls et al. (combination chair and exercise unit).

Additional patents showing exercise devices include U.S. Pat. No. 5,171,295, issued Dec. 15, 1992 to F. Schwalm, Jr. (portable pulley exerciser body fitness apparatus); U.S. Pat. No. 5,178,596, issued Jan. 12, 1993 to N. McIntire (exercise apparatus) ; U.S. Pat. No. 5,324,243, issued Jun. 28, 1994 to W. Wilkinson (universal, portable exercise apparatus adaptable to fit a chair); U.S. Pat. No. 5,362,296, issued Nov. 8, 1994 to L. Wang et al. (chair mounting exercising unit) ; U.S. Pat. No. 6,048,292, issued Apr. 11, 2000 to M. Gasquez (combination arm exercise apparatus and propulsion aid for a wheelchair) ; U.S. Pat. No. 6,117,056, issued Sep. 12, 2000 to T. Cataldi, Jr. et al. (isotonic exercise device attachable to chair); U.S. Pat. No. 6,159,133, issued Dec. 12, 2000 to R. Shugg (seat mounted workout station system); U.S. Pat. No. 6,500,104 B1, issued Dec. 31, 2002 to R. Rich (seat exercise device); International Pub. No. WO 02/056971 A1, published Jul. 25, 2002 (exercise device); Can. Pat. App. No. 2 436 231, published Jul. 25, 2002 (exercise device).

Although the related art addresses portable exercise devices that may be attached to chairs, what is needed is an easily constructed exercise device that may be attached to a wide variety of chairs. In addition, the exercise kit should allow for an extensive range of exercises the user may do.

None of the above inventions and patents, taken either singly or in combination, is seen to describe the instant invention as claimed. Thus an office gym solving the aforementioned problems is desired.

SUMMARY OF THE INVENTION

The office gym exercise kit is a portable exercise kit that is capable of attaching about a chair post and provides for a number of exercises to be performed by a user. The exercise kit contains a flexible body that is wrapped around the post and under the base of the chair then secured such that the flexible body remains in place about the chair post. Several elastic straps are included in the kit. The flexible body has retainers affixed thereon for retaining the elastic straps. Additionally, the exercise kit includes a back attachment that encircles a chair back support and contains a retainer for retaining the elastic straps. Latching devices connect the elastic straps to the retainers. The various retainers allow for different placement of the elastic straps so that multiple exercises may be performed based on which retainer and which elastic strap is used. The user extends the straps to exercise the user's arms, legs, etc.

Advantageously, the exercise kit can be adapted to a multitude of chairs, providing the chair has a base, a post and a back support. Additionally, the kit permits the user to engage in a variety of exercises involving the arms, the legs and the back. Further, the resistance of the elastic straps of the exercise kit may be varied based on the preferences of the user.

One aspect of the invention is that the flexible body and the flexible band are removably affixed to the chair about the chair post and the chair back support respectively. The flexible body and flexible band may be affixed about the post and the back support in a variety of ways. The flexible body and flexible band may be affixed using laces and apertures in the flexible body and flexible band. The flexible body and flexible band may be affixed using hook and loop fasteners. A further aspect of the invention is that the exercise kit allows the user to engage in multiple exercises. An additional aspect of the invention is that the components of the exercise kit are lightweight and simply assembled.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
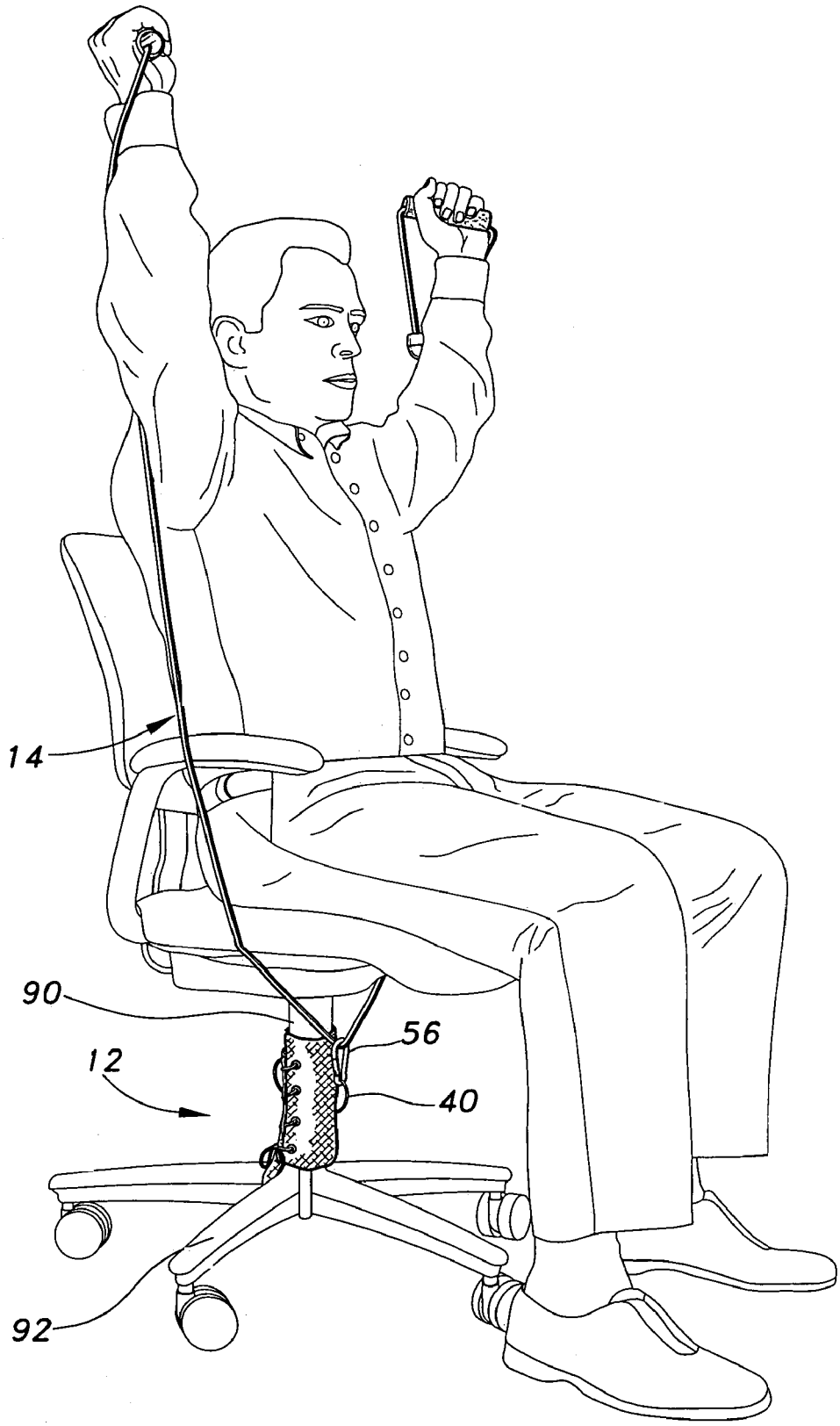
FIG. 1A is an environmental, perspective view of an exercise device according to the present invention demonstrating a first exemplary exercise.

The present invention is an exercise kit, designated generally as 10 in the drawings. The exercise kit 10 is made up of a flexible body 12, a first elastic strap 14 used primarily for arm exercises, a second elastic strap 16 used primarily for leg exercises, and a first plurality of retainers 40 for restraining the elastic straps 14 and 16 to the flexible body 12. Additionally, the exercise kit 10 may include a flexible band 18 and a flexible band retainer 44 for restraining the elastic straps 14 and 16 to the flexible band 18.

Figure 2:
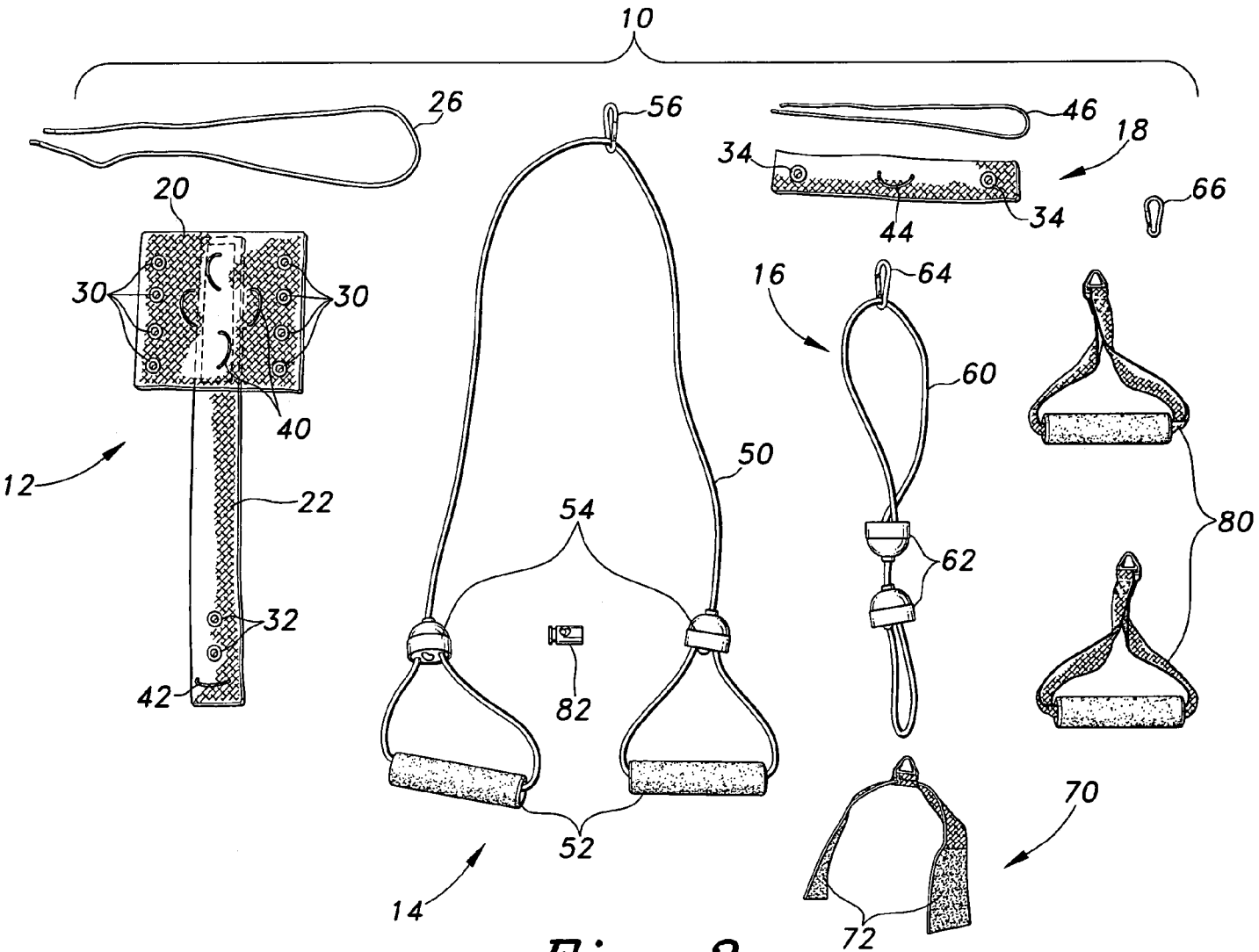
FIG. 2 is a planar view of an exercise kit according to the present invention.

Referring first to FIG. 2, the flexible body 12 of the exercise kit 10 is constructed with a flexible fabric and has a generally rectangular portion 20 with an elongated strap 22 extended therefrom. The rectangular portion 20 includes a first plurality of apertures 30 situated on two sides of the rectangular portion 20. The rectangular portion 20 additionally contains a first plurality of retainers 40 used to restrain the first elastic strap 14 or the second elastic strap 16. The elongated strap 22 includes a second plurality of apertures 32 located on the end of the elongated strap 22. The elongated strap 22 additionally has at least one retainer 42. The flexible body 12 is affixed to a chair post 90 by passing a first lace 26 through the first plurality of apertures 30 and the second plurality of apertures 32, thereby uniting the flexible body 12 about the chair post 90.

The flexible band 18 of the exercise kit 10 is constructed with a flexible fabric. The flexible band 18 has a third plurality of apertures 34 located on either end of the band 18 and at least one retainer 44. A second lace 46 may be passed through the third plurality of apertures 34 to unite the flexible band 18 about a chair back support 94.

The first elastic strap 14 is constructed with a first elastic band 50, a pair of elastic handles 52 at either end of the first elastic band 50, a first plurality of resistance adjusting pieces 54. A first latching mechanism 56 is clipped onto the first elastic band 50. The first latching mechanism 56 allows for attachment between the first elastic strap 14 and either of the flexible body 12 or the flexible band 18.

The second elastic strap 16 is constructed with a second elastic band 60 and a second plurality of resistance adjusting pieces 62. A second latching mechanism 64 is clipped onto the second elastic band 60. The second latching mechanism 64 allows for attachment between the second elastic strap 16 and either of the flexible body 12 or the flexible band 18.

The first and second plurality of resistance adjusting pieces 54 and 62 may be adjusted to tighten or loosen the first and second elastic straps 14 and 16 respectively. The resistance adjusting pieces 54 and 62 may be substituted by a plurality of spring-loaded adjusting pieces 82.

The exercise kit 10 may additionally include an ankle attachment 70 and a pair of attachable handles 80. The ankle attachment 70 may be fastened onto the second elastic strap 16 by a third latching mechanism 66. The ankle attachment 70 is secured about an ankle by a hook and loop fastener 72. The pair of attachable handles 80 may be fastened onto the second elastic strap 16 by the third latching mechanism 66.

FIG. 1A shows a first exemplary exercise that a user may engage in while using the exercise kit 10. The flexible body 12 of the exercise kit 10 is attached to a chair post 90 and the base 92 of a chair. The first latching mechanism 56 fastens the first elastic strap 14 onto one of the first plurality of retainers 40 on the flexible body 12.

Figure 1B:
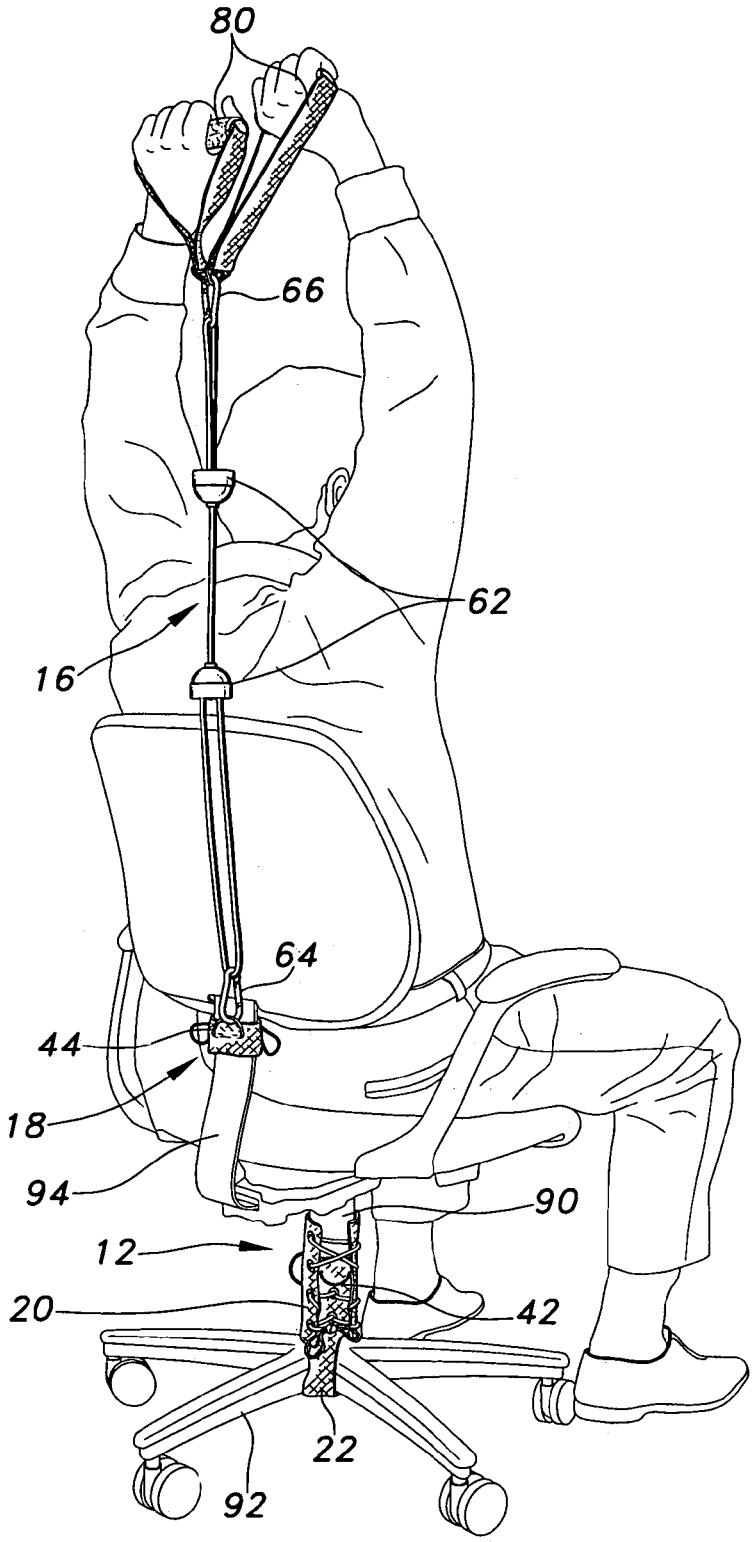
FIG. 1B is an environmental, perspective view of the exercise device according to the present invention demonstrating a second exemplary exercise.

FIG. 1B shows a second exemplary exercise that a user may engage in while using the exercise kit 10. The elongated strap retainer 42 is situated between the laced portion of the flexible body 12. The elastic band 18 is shown attached about the chair back support 94. The elastic band 18 is tied to the chair back support 94 by threading the second lace 46 through the third plurality of apertures 34. The second elastic strap 16 is attached to the flexible band 18 using the second latching mechanism 64 that latches the second elastic strap 16 to the flexible band retainer 44. The pair of attachable handles 80 is connected to the second elastic strap 16 by the third latching mechanism 66. A user may change the second plurality of resistance adjusting pieces 62 to provide varying levels of resistance.

Figure 1C:
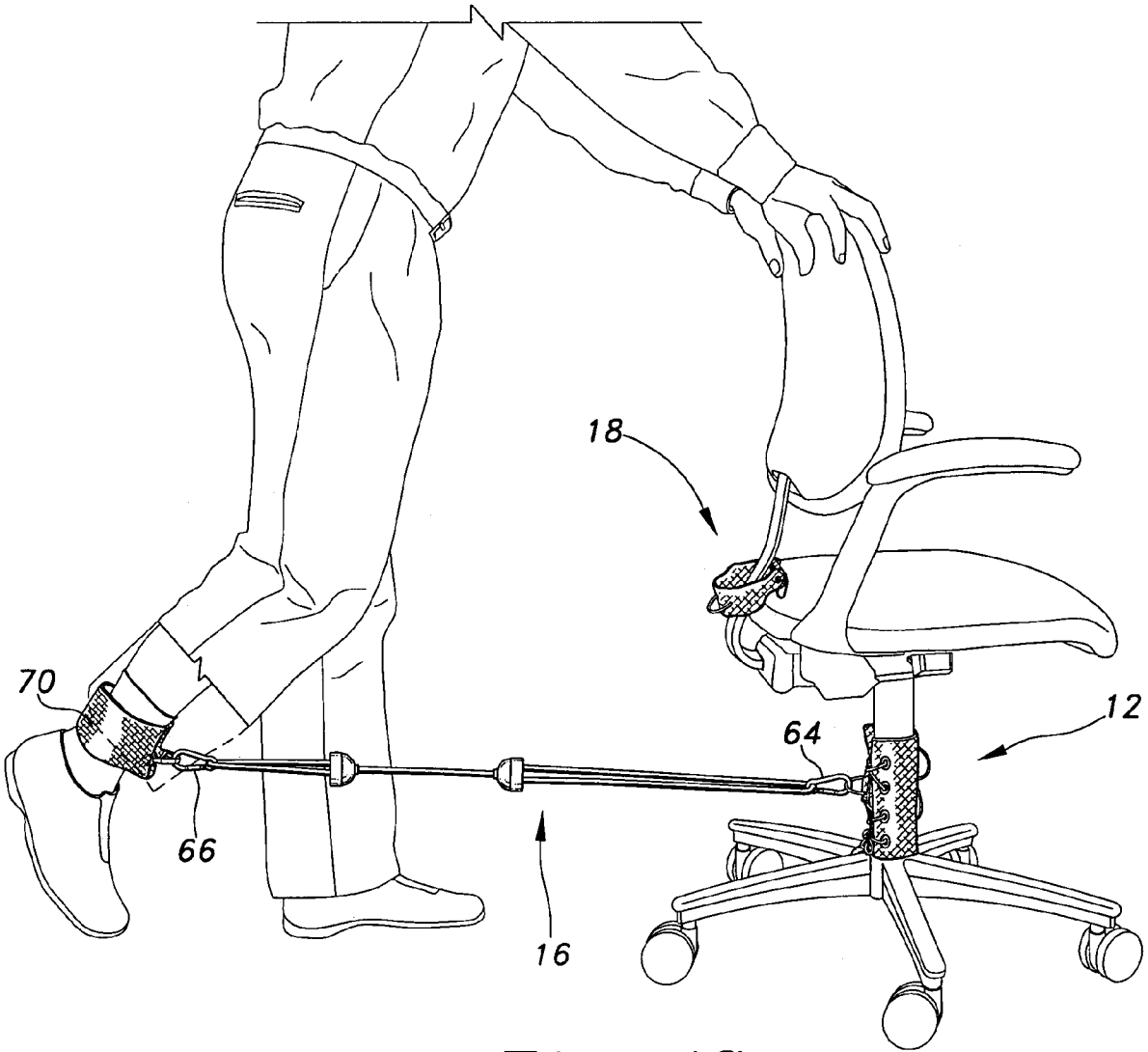
FIG. 1C is an environmental, perspective view of the exercise device according to the present invention demonstrating a third exemplary exercise.

FIG. 1C illustrates a third exemplary exercise a user may engage in when using the exercise kit 10. The second elastic strap 16 is attached to the flexible body 12 using the second latching mechanism 64. The ankle attachment 70 is joined to the second elastic strap 16 by the third latching mechanism 66.

Figure 3:
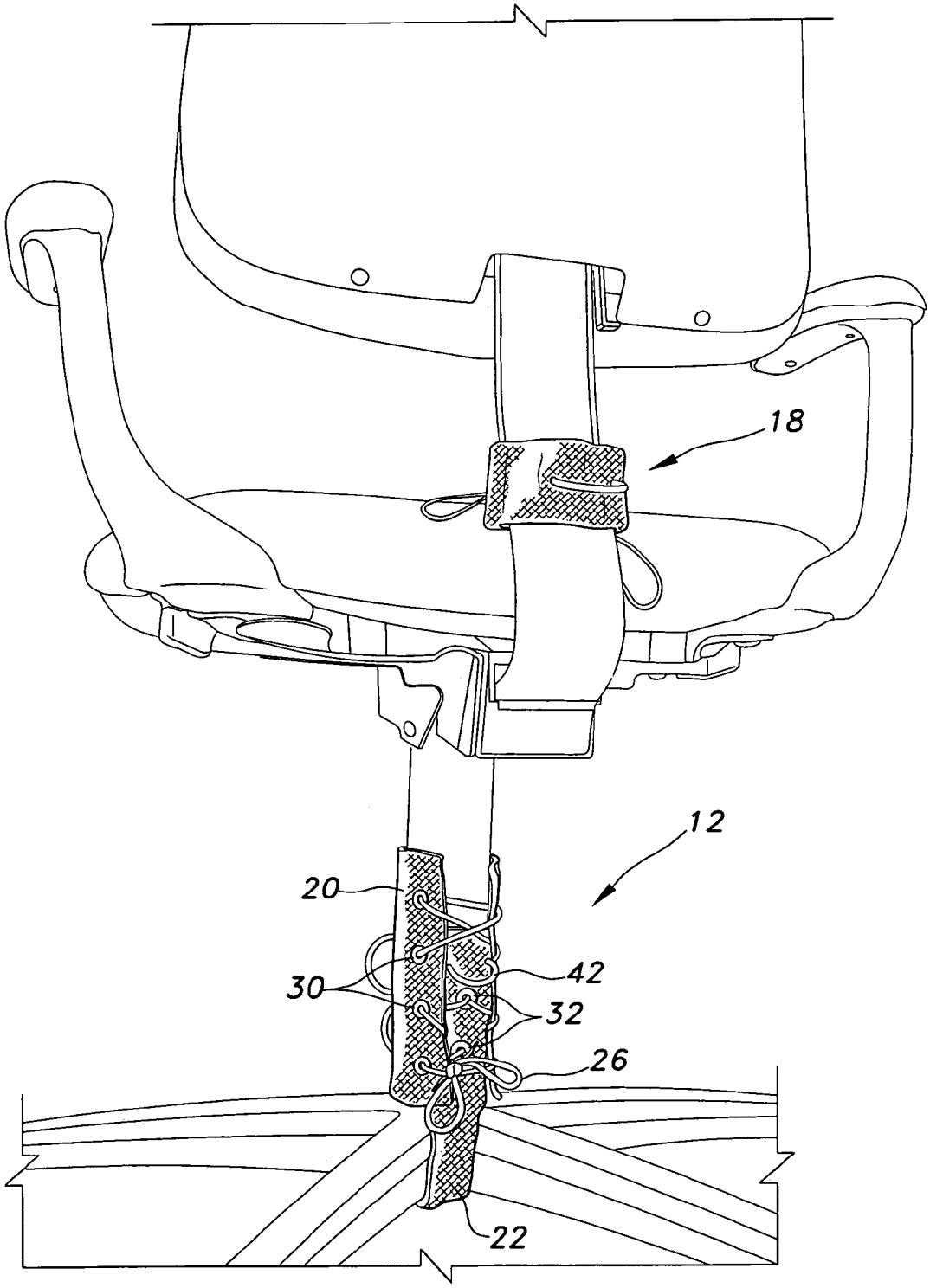
FIG. 3 is an elevational rear view of a flexible body and a flexible band of the exercise kit according to the present invention.

As shown in FIG. 3, the flexible body 12, composed of a rectangular portion 20 and an elongated strap 22, is wrapped about the post 90 and base 92 of a chair. The first lace 26 is threaded through the first and second plurality of apertures 30 and 32 and tied so that the flexible body is stabilized about the post 90 and is unable to move while the user exercises. The elongated strap retainer 42 is situated at the back of the chair post 90. The flexible band 18 is secured about the chair back support 94 by tying the second lace 46 through the third plurality of apertures 34.

Figure 4:
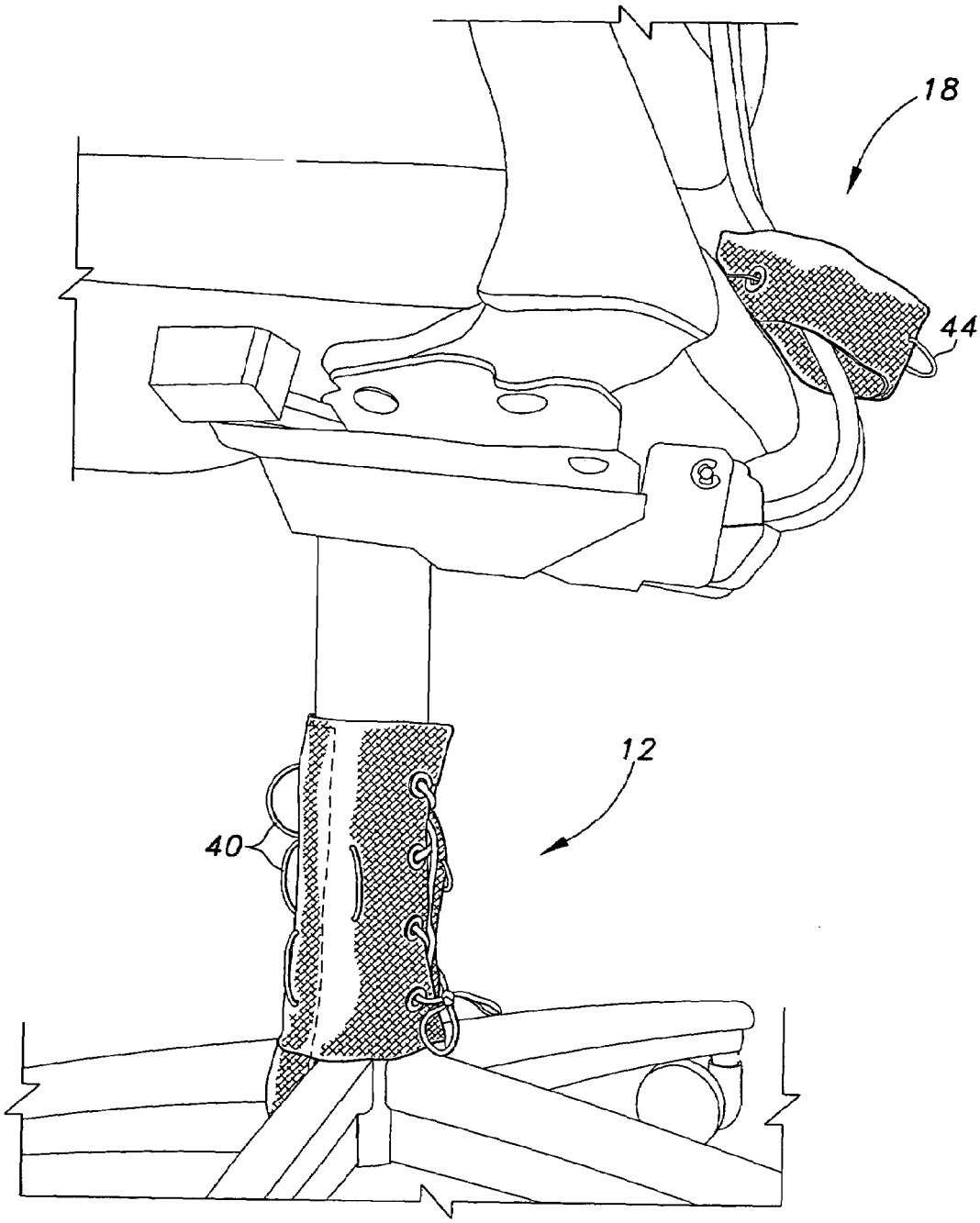
FIG. 4 is an elevational side view of the flexible body and the flexible band of the exercise kit according to the present invention.

As shown in FIG. 4, a first plurality of retainers 40 is located on the front portion of the flexible body 12. A flexible band retainer 44 is located on the flexible band 18.

Additionally, a hook and loop attachment may be used in place of the lace and aperture combination fastener.

An exercise device combines the components of the exercise kit 10 such that the components may be used in concert.

It is to be understood that the present invention is not limited to the embodiments described above, but encompasses any and all embodiments within the scope of the following claims.

We claim:

1. An exercise kit for attachment to a chair having a central post, a base, and a chair back support, said exercise kit comprising:

(a) a generally T-shaped flexible body constructed of flexible fabric, the top of the T-shaped flexible body comprising a generally rectangular portion having a plurality of retainers secured thereon, an elongated strap secured to said generally rectangular portion and extending outwardly from and substantially perpendicular to one of the sides of the generally rectangular portion, said elongated strap terminating in a free end, said generally rectangular portion further including fastening means located adjacent the sides of the rectangular body perpendicular to said one side for affixing said rectangular portion of said flexible body about a central post of a chair, means for affixing said elongated strap about a chair base, and means for affixing said rectangular portion to said elongated strap free end;

(b) a flexible band, said flexible band comprising of strip of flexible material having at least one retainer affixed thereon, said flexible band including fastening means for securing said flexible band about a chair back support;

(c) a first elastic exercise strap, said first elastic exercise strap comprising a first elastic band having a pair of elastic handles located at either end of the first elastic band and permanently affixed thereon, and a first pair of resistance adjusting pieces to tighten or loosen the tension of said first elastic band;

(d) a second elastic exercise strap, said second elastic exercise strap comprising a second elastic band and a second pair of adjusting pieces to tighten or loosen the tension of said second elastic band;

(e) an ankle attachment, said ankle attachment comprising a strip of flexible material which is removably securable to said second elastic strap, said ankle attachment including mating hook and loop fasteners for removably securing said ankle attachment about a person's ankle;

(f) a plurality of attachable handles, each of said plurality of attachable handles being removably securable to said second elastic strap; and (g) a means for latching said first elastic strap and said second elastic strap onto said plurality of retainers located on said flexible body and said flexible band.

2. The exercise kit according to claim 1, wherein said fastening means for affixing said rectangular portion of said flexible body about a central post of a chair comprises a plurality of apertures and a lace, said plurality of apertures being located on the rectangular portion and the elongated strap, said lace capable of being extended through said plurality of apertures, said lace attaching the rectangular portion to the elongated strap.

3. The exercise kit according to claim 1, wherein said fastening means for affixing said rectangular portion of said flexible body about a central post of a chair are hook and loop fasteners, said hook and loop fasteners being situated on the flexible body and the elongated strap.

4. The exercise kit according to claim 1, wherein said fastening means for securing said flexible band about a chair back support comprises a plurality of apertures and a lace, said lace capable of being extended through said plurality of apertures, said lace attaching the flexible band about the chair back support.

5. The exercise kit according to claim 1, wherein said fastening means for securing said flexible band about a chair back support are hook and loop fasteners.

6. The exercise kit according to claim 1, wherein said plurality of retainers are D-rings.

7. The exercise kit according to claim 1, wherein said plurality of retainers are nylon strips.

8. The exercise kit according to claim 1, wherein said plurality of adjusting pieces are a plurality of spring-loaded adjusting pieces.

9. The exercise kit according to claim 1, wherein said means for latching said first elastic strap and said second elastic strap onto said plurality of retainers are a plurality of latching hooks.

* * * * *